US006840348B2

(12) United States Patent
Takewaka et al.

(10) Patent No.: US 6,840,348 B2
(45) Date of Patent: Jan. 11, 2005

(54) EXHAUST MUFFLER

(75) Inventors: Tomoyuki Takewaka, Wako (JP); Seiichirou Eguchi, Wako (JP); Yuuichi Katou, Wako (JP); Noritoshi Iwase, Wako (JP); Ichirou Sudou, Wako (JP); Takashi Asai, Aichi (JP)

(73) Assignees: Honda Giken Kogyo Kabushiki Kaisha, Tokyo (JP); Nihon Glass Fiber Industrial Co. Ltd., Aichi (JP)

( * ) Notice: Subject to any disclaimer, the term of this patent is extended or adjusted under 35 U.S.C. 154(b) by 0 days.

(21) Appl. No.: 10/187,532

(22) Filed: Jul. 2, 2002

(65) Prior Publication Data

US 2003/0019688 A1 Jan. 30, 2003

(30) Foreign Application Priority Data

Jul. 30, 2001 (JP) ..... 2001-230038

(51) Int. Cl.[7] ..... F01N 1/10

(52) U.S. Cl. ..... 181/252; 181/247; 181/256; 181/267

(58) Field of Search ..... 181/252, 247, 181/256, 267

(56) References Cited

U.S. PATENT DOCUMENTS 3,884,037 A * 5/1975 Barber et al. ..... 60/292
5,350,888 A * 9/1994 Sager et al. ..... 181/247
6,148,955 A * 11/2000 Wolf et al. ..... 181/252

FOREIGN PATENT DOCUMENTS

JP 2-513707 7/1996

* cited by examiner

*Primary Examiner*—Shih-Yung Hsieh
(74) *Attorney, Agent, or Firm*—Carrier, Blackman & Associates, P.C.; Jospeh P. Carrier; William D. Blackman

(57) ABSTRACT

An exhaust muffler for an internal combustion engine included in a motorcycle includes a perforated inner pipe (32), an outer pipe (31) coaxially surrounding the inner pipe (32), and a glass wool mat (33) packed in a space between the inner pipe (32) and the outer pipe (31). A three-layer protective structure is formed by winding an inner stainless steel wire mesh (34) wound around the inner pipe (32), winding a stainless steel wool mat (35) around the inner stainless steel wire mesh (934), and winding an outer stainless steel wire mesh (36) around the stainless steel wool mat (35). The glass wool mat (33) is wound around the three-layer structure. The three-layer structure extends the life of the glass wool mat (33) even if the temperature and pressure of the exhaust gas discharged by the internal combustion engine increase.

14 Claims, 6 Drawing Sheets

EXHAUST MUFFLER

BACKGROUND OF THE INVENTION

1. Field of the Invention

The present invention relates to an exhaust muffler for a vehicle, such as a motorcycle.

2. Description of the Related Art

A prior art exhaust muffler for a motorcycle, disclosed in Japanese Utility Model Registration No. 2513707 has a perforated inner pipe, an outer pipe, a glass wool mat, as a sound-absorbing element, packed in an annular space between the perforated inner and the outer pipe, and a steel wool mat interposed between the glass wool mat and the inner pipe to protect the glass wool mat from the damaging effect of the high-temperature, high-pressure exhaust gas.

A steel wool mat is formed by subjecting superposed bundles of ferrous metal filaments to needle punching to make the ferrous metal filaments entangled. A steel wool mat is wound around the perforated inner pipe to protect the glass wool mat wound around the steel wool mat from the damaging effect of the high-temperature, high-pressure exhaust gas.

The combustion efficiency and output of automotive internal combustion engines have been progressively increased in recent years, raising the temperature and pressure of the exhaust gas in the muffler. Consequently, ferrous metal filaments forming the steel wool mat for protecting the glass wool mat exert detrimental effects on the glass wool mat under a high-temperature, high-pressure condition, adversely affecting the durability of the glass wool mat.

The present invention has been made in view of the foregoing problem and it is therefore an object of the present invention to provide an exhaust muffler provided with a glass wool mat effectively protected from the damaging effect of the high-temperature, high-pressure exhaust gas on the glass wool mat.

SUMMARY OF THE INVENTION

With the foregoing object in view, according to one aspect of the present invention, an exhaust muffler includes: a perforated inner pipe; an outer pipe coaxially surrounding the inner pipe; and a glass wool mat formed by packing glass wool in a space between the inner and the outer pipe; wherein a three-layer protective structure consisting of an inner stainless steel wire mesh wound around the inner pipe, a stainless steel wool mat wound around the inner stainless steel wire mesh, and an outer stainless steel wire mesh wound around the stainless steel wool mat is interposed between the inner pipe and the glass wool mat.

The three-layer protective structure is formed by holding the stainless steel wool mat between the inner and the outer stainless steel wire mesh, and the glass wool mat is protected from the high-temperature, high-pressure exhaust gas by the three-layer protective structure.

Since the outer stainless steel wire mesh prevents the stainless steel wool mat from acting directly on the glass wool mat, the life of the glass wool layer can be extended even if the temperature and pressure of the exhaust gas increase.

Desirably, the three-layer protective structure consisting of the inner and the outer stainless steel wire mesh and the stainless steel wool mat is tightened by rolling the same between rollers under pressure applied thereto by the rollers.

Since the protective structure consisting of the inner and the outer stainless steel wire mesh and the stainless steel wool mat is thus formed by tightly winding the stainless steel wire meshes and the stainless steel wool mat around the inner pipe under pressure applied thereto by the rollers, the stainless steel wool mat has a uniform density, the protective structure retains its designed shape and has stable quality, and the exhaust muffler can be easily fabricated.

Preferably, the three-layer protective structure consisting of the inner and the outer stainless steel wire mesh and the stainless steel wool mat and surrounding the inner pipe is wrapped in a knitted, cylindrical stainless steel wire net to retain the same in its designed shape.

The knitted, cylindrical stainless steel wire net formed by knitting stainless steel cords and covering the outer stainless steel wire mesh wound around the stainless steel wool mat holds the trailing edge of the outer stainless steel wire mesh in place to retain the designed shape of the three-layer protective structure, which facilitates the fabrication of the exhaust muffler and work for carrying component parts.

Preferably, glass cloth is wound around the cylindrical stainless steel wire net, and the glass wool mat is wound on the glass cloth.

When the three-layer protective structure consisting of the inner and the outer stainless steel wire mesh and the stainless steel wool mat is wrapped in the cylindrical stainless steel wire net, and the glass cloth is wound around the cylindrical stainless steel wire net, the glass wool layer can be surely protected from the high-temperature, high-pressure exhaust gas and the action of the stainless steel wool mat, which extends the life of the glass wool mat.

The inner pipe may be a round pipe, the outer pipe may be an elliptic pipe, and the glass wool mat may have a uniform thickness T (see FIG. 7) and may be wound in layers around the inner pipe, glass wool strips may be held between the layers of the glass wool mat at positions respectively corresponding to the opposite ends of a major diameter of the elliptic outer pipe.

The glass wool mat can be formed in a substantially uniform density by winding the glass wool mat around the inner pipe with the glass wool strips extended on parts of the inner pipe respectively corresponding to the opposite ends of the major diameter of the outer pipe so as to be held between the outer pipe and the glass wool mat, so that the quality including sound-absorbing effect of the exhaust muffler can be improved and the life of the glass wool mat can be extended.

According to another aspect of the present invention, an exhaust muffler includes: a perforated inner pipe; an outer pipe coaxially surrounding the inner pipe; and a glass wool mat formed by packing glass wool in a space between the inner and the outer pipe; wherein a two-layer protective structure is formed by winding a stainless steel wire mesh around the inner pipe, and winding a stainless steel wool mat around the stainless steel wire mesh, the two-layer protective structure is wrapped in a knitted, cylindrical stainless steel wire net to retain the two-layer structure in a designed shape, and the glass wool mat is wound around the knitted, cylindrical stainless steel wire net.

The glass wool mat wound around the two-layer protective structure consisting of the stainless steel wire mesh and the stainless steel wool mat wound around the stainless steel wire mesh, and wrapped in the knitted, cylindrical stainless steel wire net can be protected from the high-temperature, high-pressure exhaust gas.

The knitted, cylindrical stainless steel wire net covering the two-layer protective structure holds the trailing edge of the stainless steel wool mat wound around the stainless steel wire mesh in place to retain the two-layer protective structure in its designed shape. Thus, the exhaust muffler needs a small number of parts and can be easily fabricated, and the two-layer protective structure wrapped in the knitted, cylindrical stainless steel wire net facilitates the work for carrying out the same.

In the exhaust muffler provided with the two-layer protective structure, the two-layer protective structure may be formed by tightly winding the stainless steel wool mat around the stainless steel wire mesh with pressure applied thereto by rollers, the two-layer protective structure may be wrapped in the knitted, cylindrical stainless steel wire net to retain the two-layer protective structure in its designed shape, and the glass wool mat may be formed on the knitted, cylindrical stainless steel wire net.

The two-layer protective structure formed by tightly winding the stainless steel wool mat around the stainless steel wire mesh with pressure applied thereto by rollers can be easily wrapped in the knitted, cylindrical stainless steel wire net, can retain its designed shape, and facilitates the work for fabricating the exhaust muffler and the work for carrying parts.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
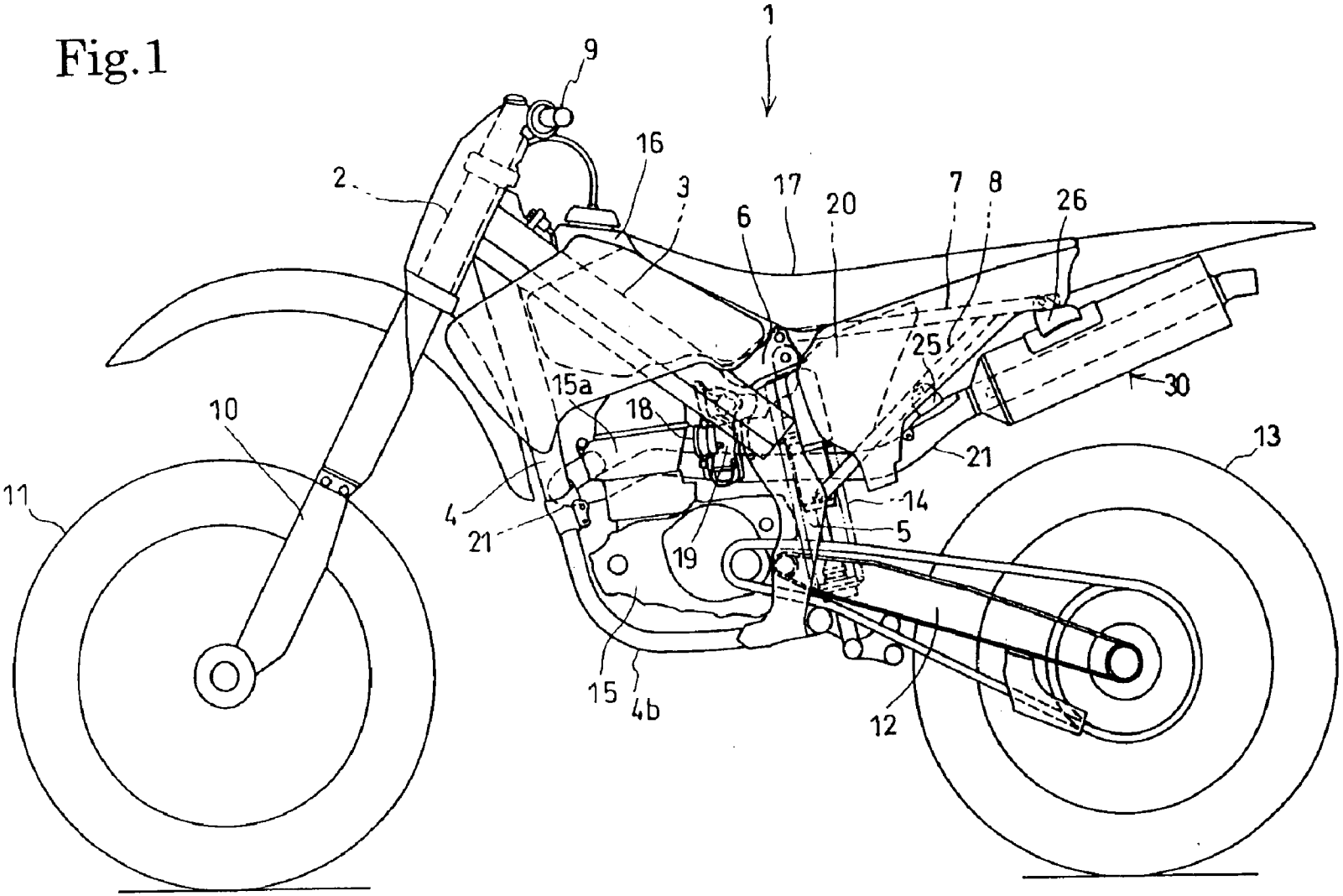
FIG. 1 is a side elevation of a motorcycle provided with an exhaust muffler in a preferred embodiment of the present invention.

Referring to FIG. 1, an off-road motorcycle 1 provided with an exhaust muffler 30 in a preferred embodiment of the present invention has a head pipe, a pair of bifurcate main frames 3 extending rearward from the head pipe 2, a down tube 4 extending downward from the head pipe 2, a lower pipe 4*b* extending rearward from the lower end of the down tube 4, and a pivot plate 5 joined to the rear ends of the pair of main frames 3 and the rear end of the lower pipe 4*b*. An upper bracket 6 interconnects the rear ends of the pair of main frames 3. A seat rail 7 extends rearward from the upper bracket 6. A rear frame lower pipe 8 has one end connected to the rear end of the seat rail 7 and the other end connected to the pivot plate 5. A front fork 10 has an upper part supported for turning on the head pipe 2, and a pair of bifurcate arms having lower ends supporting a front wheel 11 for rotation. A handlebar 9 is attached to the upper end of the front fork 10 to turn the front fork 10. A rear fork 12 has a front end pivotally supported on a lower part of the pivot plate 5, and a pair of bifurcate arms having rear ends supporting a rear wheel 13 for rotation. A rear shock absorber 14 is extended between the upper bracket 6 and the rear fork 12.

A single-cylinder four-stroke cycle internal combustion engine 15 is suspended from the main frames 3 and the pivot plate 5 in a space behind the down tube 4. A fuel tank 16 is disposed above the internal combustion engine 15 and is mounted on the main frame 3. A seat 17 is disposed behind the fuel tank 16 and is supported on the seat rail 7. The internal combustion engine 15 has a crankcase, a cylinder head 15*a* joined to a cylinder held on the crankcase in a substantially upright position, an intake pipe 18 extended rearward from the cylinder head 15*a*, a carburetor 19 connected to the intake pipe 18, an air cleaner 20 connected to the carburetor 19, and an exhaust pipe 21 connected to a front part of the cylinder head 15*a* and extending rearward on the right side of the cylinder. The exhaust muffler 30 is connected to the rear end of the exhaust pipe 21 so as to extend obliquely upward toward the rear. A rear end part of the exhaust pipe 21 connected to the exhaust muffler 30 is fixed to a bracket 25 attached to a middle part of the rear frame lower pipe 8. The exhaust muffler 30 connected to the rear end part of the exhaust pipe 21 is fixed to a bracket 26 attached to the rear end of the seat rail 7.

Figure 2:
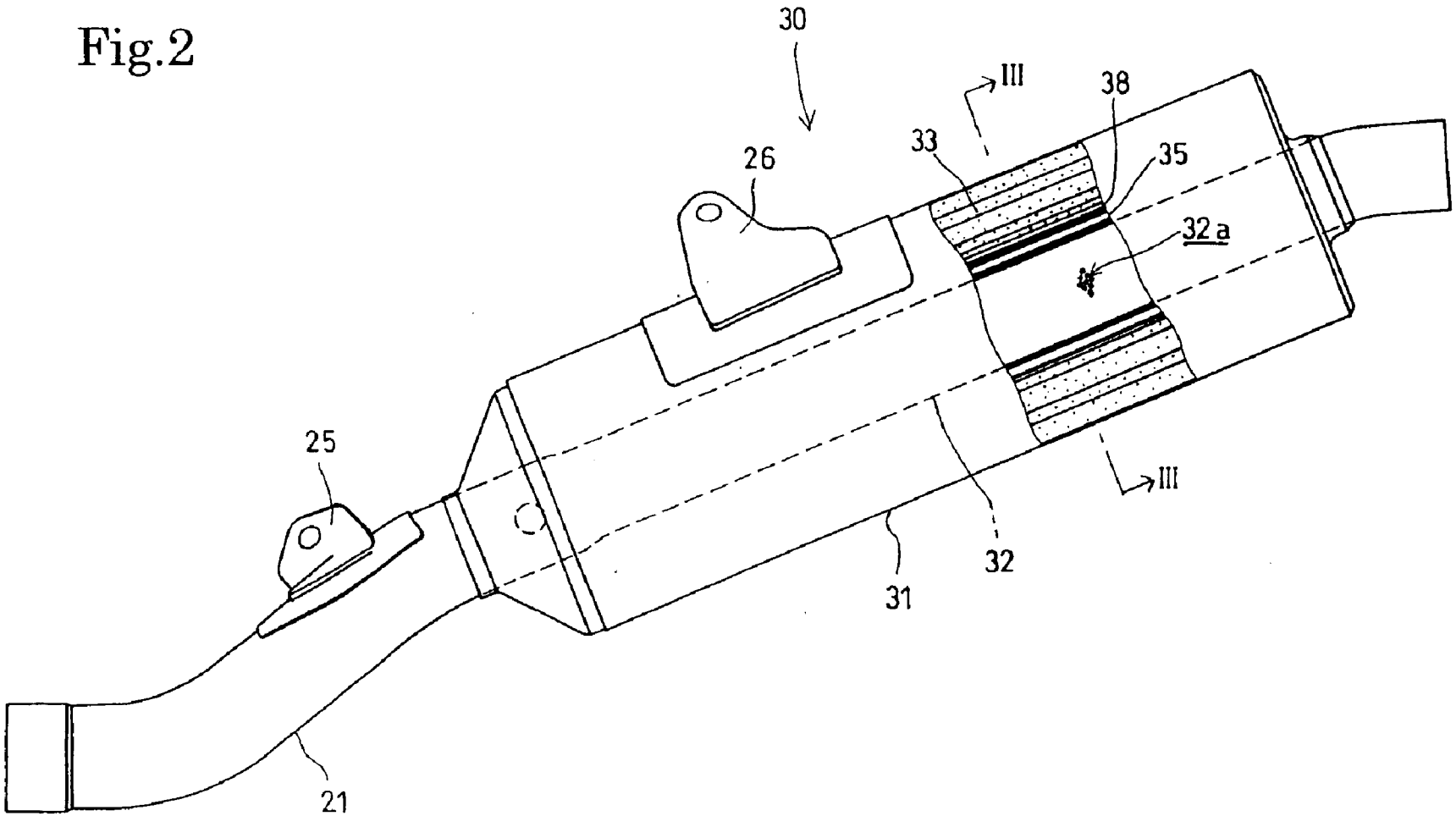
FIG. 2 is a partly sectional side elevation of the exhaust muffler shown in FIG. 1.

The construction of the exhaust muffler 30 will be described with reference to FIGS. 2 and 3. The exhaust muffler 30 has an elliptic outer pipe 31, and a round inner pipe 32 extended through the outer pipe 31 and connected to the exhaust pipe 21. The inner pipe 32 is provided with many small holes 32*a*. An annular space between the outer pipe 31 and the inner pipe 32 is packed with a glass wool mat 33 serving as a sound-absorbing member. An inner stainless steel wire mesh 34 of stainless steel wires is wound around the inner pipe 32 provided with the small holes 32*a*, a stainless steel wool mat 35 of intertwining stainless steel filaments is wound around the inner stainless steel wire mesh 34, and an outer stainless steel wire mesh 36 is wound around the stainless steel wool mat 35 to form a three-layer structure. The three-layer structure is wrapped in a flexible, diametrically expandable, cylindrical stainless steel wire net 37 formed by knitting stainless steel cords, and a glass cloth 38 is wound around the stainless steel wire net 37. The glass wool mat 33 is packed in a space between the glass cloth 38 and the outer pipe 31. Thus, the three-layer structure formed by holding the stainless steel wool mat 35 between the stainless steel wire meshes 34 and 36, the stainless steel wire net 37 and the glass cloth 38 are interposed between the inner pipe 32 and the glass wool mat 33 to protect the glass wool mat 33 from the high-temperature, high-pressure exhaust gas.

Figure 4:
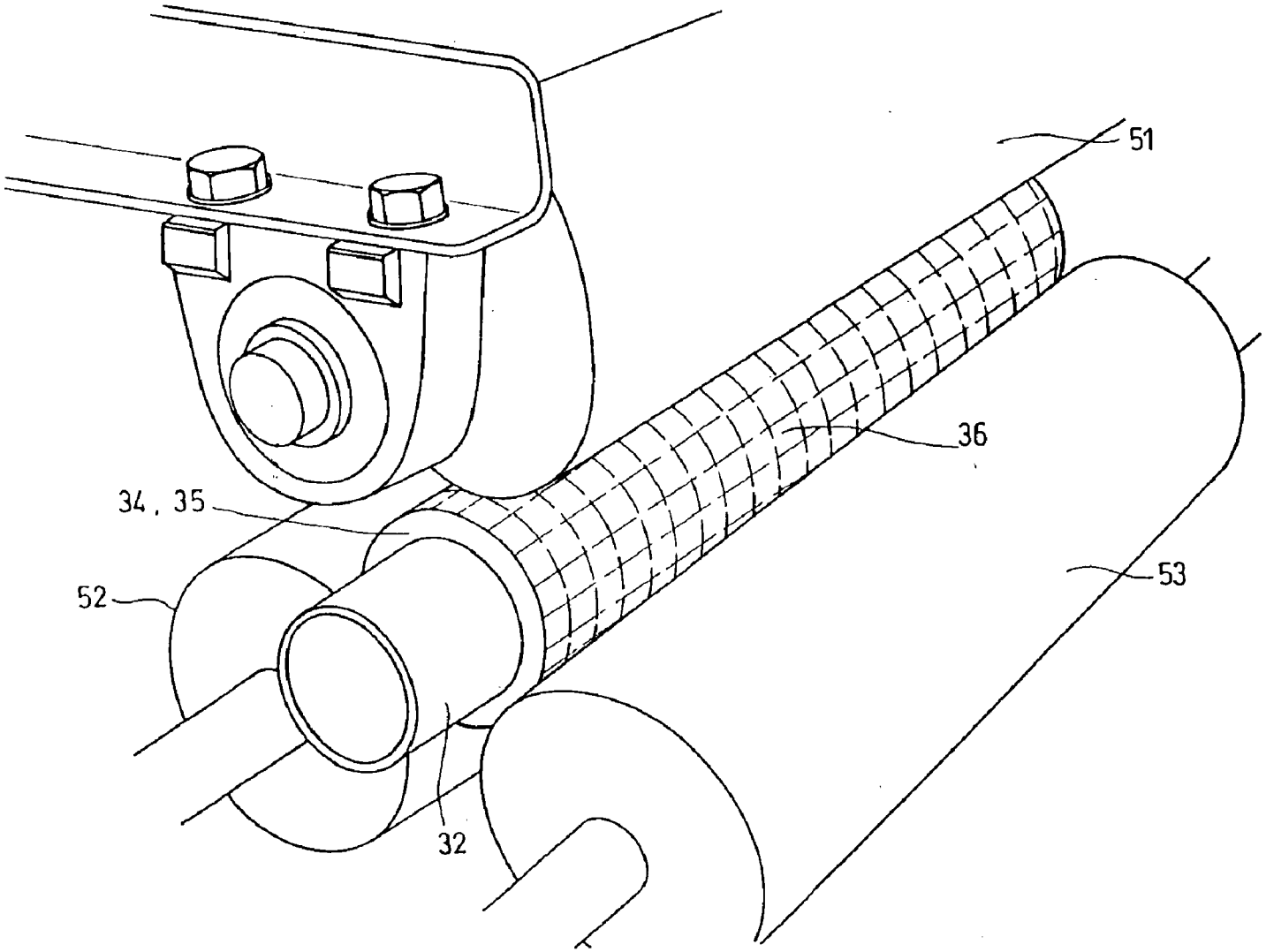
FIG. 4 is a perspective view of assistance in explaining a process of forming a three-layer protective structure by using three rollers.
Figure 5:
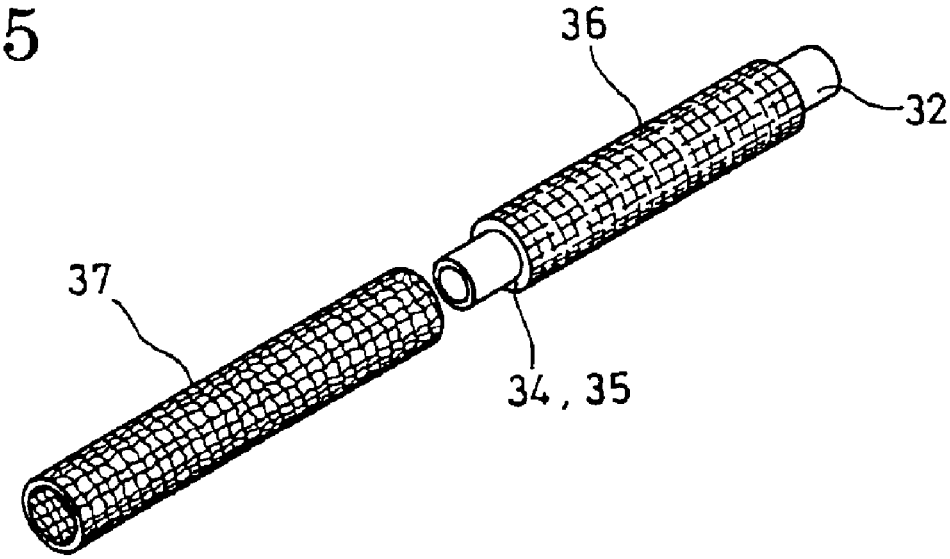
FIG. 5 is a perspective view of assistance in explaining a process of wrapping the three-layer protective structure in a knitted, cylindrical stainless steel wire net.

When fabricating the exhaust muffler 30, the inner stainless steel wire mesh 34, the stainless steel wool mat 35 and the outer stainless steel wire mesh 36 are wound in that order around the inner pipe 32 to form the three-layer structure. Then, three rollers 51, 52 and 53 are pressed against the three-layer structure as shown in FIG. 4, and the three rollers 51, 52 and 53 are rotated to tighten the three-layer structure. The tightened three-layer structure formed on the inner pipe 32 is inserted in the radially expandable stainless steel wire net 37 as shown in FIG. 5 to ensure that the three-layer structure is retained in its designed shape. As the glass wool forming the glass wool mat, SUS 434(Japanese Industrial Standards) can be used, while as the wire glass wool forming the wire meshes, SUS 304 (Japanese Industrial Standards) can be used.

Figure 6:
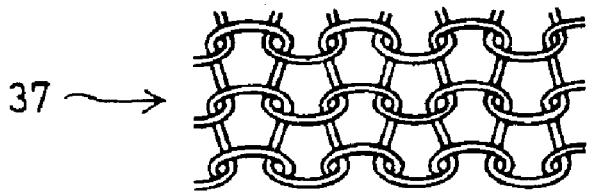
FIG. 6 is an enlarged, fragmentary view of the knitted, cylindrical stainless steel wire net.
Figure 7:
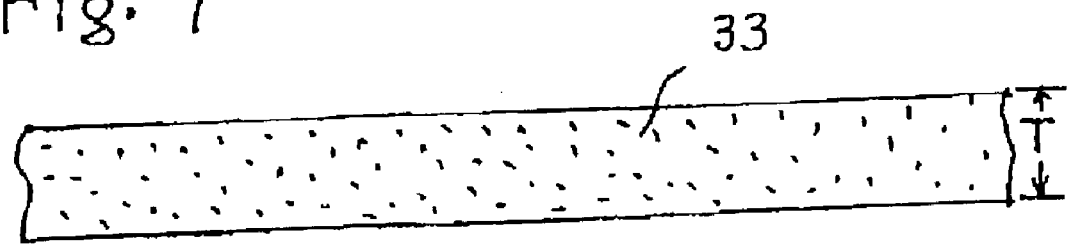
FIG. 7 is a side view of a layer of the glass wool mat.

As shown in FIG. 6, the stainless steel wire net 37 is formed in a cylindrical shape by knitting stainless steel cords. The stainless steel wire net 37 is expandable particularly diametrically. Therefore, the three-layer structure consisting of the inner stainless steel wire mesh 34, the stainless steel wool mat 35 and the outer stainless steel wire mesh 36 and wrapped in the stainless steel wire net 37 is compressed radially and hence the three-layer structure can be surely retained in its designed shape. Thus, the three-layer structure can be readily retained in its designed shape by the stainless steel wire net 37 without welding the trailing edge of the outer stainless steel wire mesh 36 of the three-layer structure, which facilitates the fabrication of the exhaust muffler.

The retention of the three-layer structure in its designed shape facilitates work for carrying parts, suppresses the variation of the density of the stainless steel wool mat 35, and stabilizes quality.

Figure 3:
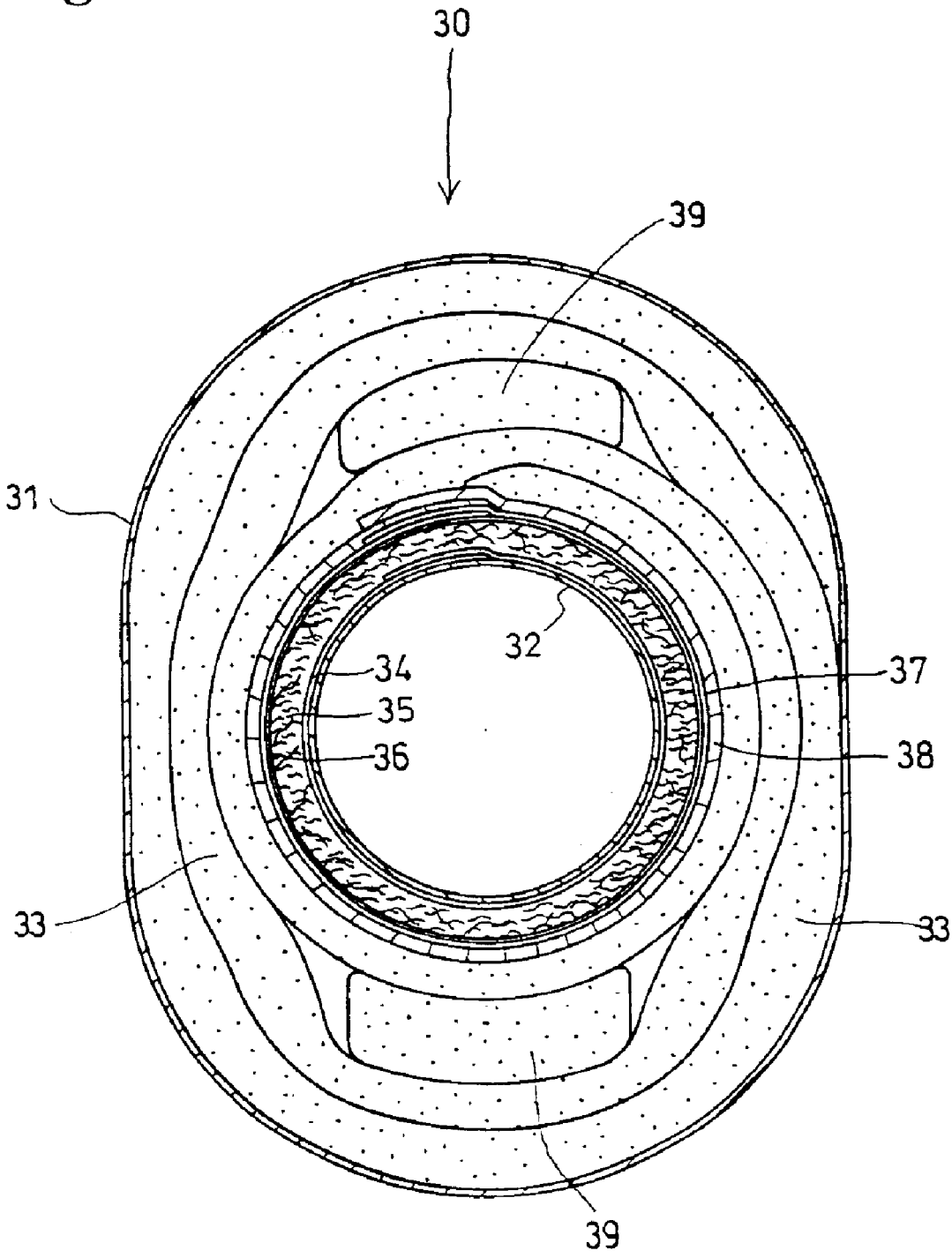
FIG. 3 is a sectional view taken on line III—III in FIG. 2.

Then, as shown in FIG. 3, the glass cloth 38 is wound around a structure formed by wrapping the three-layer structure in the stainless steel wire net 37, and the glass wool mat 33 is wound in three or four layers on the glass cloth 38. When winding the glass wool mat 33, glass wool mat strips 39 are placed between the layers of the glass wool mat 33 at positions diametrically opposite to each other to form the layers of the glass wool mat 33 in an elliptic cross section. An assembly of the inner pipe 32, the three-layer structure, the stainless steel wire net 37, the glass cloth 38 and the glass wool mat 33 and the glass wool strips 39 is fitted in the elliptic outer pipe 31 to assemble the exhaust muffler 30.

The glass wool mat 33 is coated partly or entirely with an inorganic silica binder. The glass wool strips 39 can be formed by cutting such a glass wool mat in strips.

When the glass wool mat 33 is wound in layers in an elliptic cross section by holding the glass wool strips 39 between the layers of the glass wool mat 33, a desired quantity of glass wool can be uniformly packed in the elliptic outer pipe 31 to improve the quality including sound-absorbing effect can be improved.

The stainless steel wool mat 35 interposed between the inner pipe 32 and the glass wool mat 33 protects the glass wool mat 33 from high-temperature, high-pressure exhaust gas. However, since the stainless steel wool mat 35 is formed by subjecting superposed bundles of stainless steel filaments to needle-punching to make the stainless steel filaments entangled, the surface of the stainless steel wool mat 35 is nappy with free ends of many stainless steel fibers. It is possible that such a nappy surface of the stainless steel wool mat 35 damages the glass wool mat 33. However, since the stainless steel wool mat 35 is sandwiched between the stainless steel wire meshes 34 and 36 to form the three-layer structure, and the three-layer structure is wrapped in the stainless steel wire net 37, the stainless steel wool mat 35 is unable to act directly on the glass wool mat 33. Therefore, even if the temperature and pressure of the exhaust gas increases, the glass wool mat 33 is not deteriorated by the stainless steel wool mat 35, and hence the glass wool mat 33 has an extended life.

In some cases, a two-layer structure consisting of the stainless steel wire mesh 34 and the stainless steel wool mat 35, and wrapped in the stainless steel wire net 37 can be effectively employed instead of the three-layer structure consisting of the stainless steel wool mat 35 and the stainless steel wire meshes 34 and 36, and wrapped in the stainless steel wire net 37. The trailing edge of the stainless steel wool mat 35 is held in place by the stainless steel wire net 37 to retain the two-layer structure in its designed shape. When the two-layer structure is employed, the number of parts can be reduced, the work for assembling the exhaust muffler can be facilitated and the work for carrying parts can also be facilitated. be facilitated and the work for carrying parts can also be facilitated.

Since the stainless steel wire net 37 is interposed between the stainless steel wool mat 35 and the glass wool mat 33, the glass wool mat 35 is not deteriorated and has an extended life.

The glass cloth 38 is used to ensure the protection of the glass wool mat 35 from the high-temperature, high-pressure exhaust gas and the damaging effect of the stainless steel wool mat 35. However, in some cases, only the stainless steel wire mesh 36 or the stainless steel wire net 37 is sufficiently effective in protecting the glass wool mat 33, and the glass cloth 38 may be omitted.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. An exhaust muffler comprising: a perforated inner pipe; an outer pipe coaxially surrounding the inner pipe; and a glass wool mat formed by packing glass wool in a space between the inner and the outer pipe;

wherein a three-layer protective structure consisting of an inner stainless steel wire mesh wound around the inner pipe, a stainless steel wool mat wound around the inner stainless steel wire mesh, and an outer stainless steel wire mesh wound around the stainless steel wool mat is interposed between the inner pipe and the glass wool mat.

2. The exhaust muffler according to claim 1, wherein the three-layer protective structure consisting of the inner and the outer stainless steel wire mesh and the stainless steel wool mat is tightened by rolling the same between rollers under pressure applied thereto by the rollers.

3. The exhaust muffler according to claim 1, wherein the three-layer protective structure consisting of the inner and the outer stainless steel wire mesh and the stainless steel wool mat and surrounding the inner pipe is wrapped in a knitted, cylindrical stainless steel wire net to retain the same in its designed shape.

4. An exhaust muffler comprising: a perforated inner pipe; an outer pipe coaxially surrounding the inner pipe; and a glass wool mat formed by packing glass wool in a space between the inner and the outer pipe;

wherein a three-layer protective structure consisting of an inner stainless steel wire mesh wound around the inner pipe, a stainless steel wool mat wound around the stainless steel wire mesh, and an outer stainless steel wire mesh wound around the stainless steel wool mat is interposed between the inner pipe and the glass wool mat;

the three-layer protective structure consisting of the inner and the outer stainless steel wire mash and the stainless steel wool mat and surrounding the inner pipe is wrapped in a knitted, cylindrical stainless steel wire net to retain the same in its designed shape; and a glass cloth is wound around the cylindrical stainless steel wire net, and the glass wool mat is wound on the glass cloth.

5. An exhaust muffler comprising: a perforated inner pipe; an outer pipe coaxially surrounding the inner pipe; and a glass wool mat formed by packing glass wool in a space between the inner and the outer pipe;

wherein a three-layer protective structure consisting of an inner stainless steel wire mesh wound around the inner pipe, a stainless steel wool mat wound around the inner stainless steel wire mesh, and an outer stainless steel wire mesh wound around the stainless steel wool mat is interposed between the inner pipe and the glass wool mat; and the inner pipe as a round pipe, the outer pipe is an elliptic pipe, and the glass wool mat has a substantially uniform thickness and is wound in layers around the outer stainless steel wire mesh, glass wool strips are held between the layers of the glass wool mat at positions respectively corresponding to the opposite ends of a major diameter of the elliptic outer pipe.

6. An exhaust muffler comprising: a perforated inner pipe; an outer pipe coaxially surrounding the inner pipe; and a glass wool mat formed by packing glass wool in a space between the inner and the outer pipe;

wherein a two-layer protective structure is formed by winding a stainless steel wire mesh around the inner pipe, and winding a stainless steel wool mat around the stainless steel wire mesh, the two-layer protective structure is wrapped in a knitted, cylindrical stainless steel wire net to retain the two-layer structure in a designed shape, and the glass wool mat is wound around the knitted, cylindrical stainless steel wire net.

7. The exhaust muffler according to claim 6, wherein the two-layer protective structure is tightened by rolling the same with pressers applied thereto.

8. An exhaust muffler comprising:

a perforated inner pipe;

an outer pipe coaxially surrounding the inner pipe;

a glass wool mat of glass wool packed in a space between the inner and the outer pipe;

a multi-layer structure of stainless steel wire mesh and stainless steel wool mat interposed between the inner pipe and the glass wool mat; and a knitted cylindrical stainless steel wire net which wraps the multi-layer protective structure to retain the same in its designed shape.

9. The exhaust muffler according to claim 8, wherein the multi-layer protective structure comprises an inner layer of steel wire mesh disposed around the inner pipe, an outer layer of stainless steel wire mesh disposed around the inner layer of stainless steel wire mesh, and at intermediate layer of stainless steel wool mat disposed between the inner outer layers of stainless steel wire mesh.

10. The exhaust muffler according to claim 8, wherein the multi-layer protective structure comprises an inner layer of steel wire mesh disposed around said inner pipe and outer layer of stainless steel wool mat disposed around the inner layer of stainless steel wire mesh.

11. The exhaust muffler according to claim 8, wherein the multi-layer protective structure as disposed around the inner pipe has a tightened form achieved by rolling the same between rollers under pressure applied thereto by the rollers.

12. An exhaust muffler comprising:

a perforated inner pipe;

an outer pipe coaxially surrounding the inner pipe;

a glass wool mat of glass wool packed in a space between the inner and the outer pipe; and a multi-layer protective structure of stainless steel wire mesh and stainless steel wool mat interposed between the inner pipe and the glass wool mat;

a knitted, cylindrical stainless steel wire net which wraps the multi-layer protective structure to retain the same in its designed shape; and a glass cloth which is wound around the cylindrical stainless steel wise net, and the glass wool mat is wound on the glass cloth.

13. An exhaust muffler comprising:

a perforated inner pipe;

an outer pipe coaxially surrounding the inner pipe;

a glass wool mat of glass wool packed in a space between the inner and the outer pipe; and a multi-layer protective structure of stainless steel wire mesh and stainless steel wool mat interposed between the inner pipe and the glass wool mat;

wherein the inner pipe is a round pipe, the outer piper is an elliptic pipe, and the glass wool mat has a substantially uniform thickness and is wound in layers around the outer stainless steel wire net, and the muffler further including glass wool strips held between the layers of the glass wool mat at positions respectively corresponding to the opposite ends of a major diameter of the elliptic outer pipe.

14. The exhaust muffler according to claim 13, wherein the glass wool mat and the glass wool strips as disposed about the inner pipe collectively have a substantially uniform density.

* * * * *

UNITED STATES PATENT AND TRADEMARK OFFICE

CERTIFICATE OF CORRECTION

PATENT NO. : 6,840,348 B2
DATED : January 11, 2005
INVENTOR(S) : Takewaka et al.

It is certified that error appears in the above-identified patent and that said Letters Patent is hereby corrected as shown below:

Column 3,
Line 44, delete the period at the end of the line and insert -- ;and --
Line 41, delete the "and" after the semicolon.

Column 7,
Line 30, change "with pressers applied" to -- with pressure applied --;
Line 39, between "a knitted" and "cylinder shape", insert a comma.

Column 8
Line 15, delete "and" after the semicolon;
Line 24, change "steel wise net" to -- steel wire net --.

Signed and Sealed this

Seventeenth Day of May, 2005

JON W. DUDAS
*Director of the United States Patent and Trademark Office*